US009091033B2

(12) United States Patent
Nakayasu et al.

(10) Patent No.: US 9,091,033 B2
(45) Date of Patent: Jul. 28, 2015

(54) FLOATING FLAP GATE

(71) Applicant: HITACHI ZOSEN CORPORATION, Osaka-shi, Osaka (JP)

(72) Inventors: Kyouichi Nakayasu, Osaka (JP); Toshiaki Morii, Osaka (JP); Ryouta Yoshiki, Osaka (JP); Masaki Inui, Osaka (JP); Yuuichirou Kimura, Osaka (JP)

(73) Assignee: HITACHI ZOSEN CORPORATION, Osaka-Shi, Osaka (JP)

( * ) Notice: Subject to any disclaimer, the term of this patent is extended or adjusted under 35 U.S.C. 154(b) by 0 days.

(21) Appl. No.: 14/364,608

(22) PCT Filed: Nov. 12, 2012

(86) PCT No.: PCT/JP2012/079294

§ 371 (c)(1),
(2) Date: Jun. 11, 2014

(87) PCT Pub. No.: WO2013/108471

PCT Pub. Date: Jul. 25, 2013

(65) Prior Publication Data

US 2014/0328628 A1 Nov. 6, 2014

(30) Foreign Application Priority Data

Jan. 16, 2012 (JP) ..... 2012-006512

(51) Int. Cl.
*E02B 7/40* (2006.01)
*E02B 8/00* (2006.01)
(Continued)

(52) U.S. Cl.
CPC . *E02B 8/00* (2013.01); *E02B 3/104* (2013.01); *E02B 7/02* (2013.01); *E02B 7/44* (2013.01)

(58) Field of Classification Search
CPC ..... E02B 7/205; E02B 7/40; E02B 7/42; E02B 3/104
USPC ..... 405/87, 92, 94, 96, 99, 100
See application file for complete search history.

(56) References Cited

U.S. PATENT DOCUMENTS 933,856 A * 9/1909 Shotwell et al. ..... 405/96
970,308 A * 9/1910 Collar ..... 405/97
(Continued)

FOREIGN PATENT DOCUMENTS

CH 180610 A * 11/1935
CH 195258 A * 1/1938
(Continued)

OTHER PUBLICATIONS

Notification of Transmittal of International Preliminary Report on Patentability for PCT/JP2012/079294, dated Jul. 31, 2014, and translation, 5 pages.
(Continued)

*Primary Examiner* — Sunil Singh
(74) *Attorney, Agent, or Firm* — Brinks Gilson & Lione

(57) ABSTRACT

The present invention provides a floating flap gap which has a door body with a forward end which is able to swing upwards, in a direction in which the water flows into an opening or at an access way, around a base end thereof serving as a fulcrum. The door body is attached to one end of a wire rope, and an auxiliary force generating means is attached to the other end thereof. This structure makes it possible to prevent an overflow during the initial influx of water and to enhance the ability of the door body to follow the water level when the door body begins to lower. This structure additionally makes it possible to mitigate a shock which occurs when raising of the door body is completed and when lowering of the door body is completed.

3 Claims, 7 Drawing Sheets

(51) Int. Cl.

| | |
|---|---|
| ***E02B 7/44*** | (2006.01) |
| ***E02B 7/02*** | (2006.01) |
| ***E02B 3/10*** | (2006.01) |

(56) References Cited

U.S. PATENT DOCUMENTS

| | | | | | |
|---|---|---|---|---|---|
| 973,172 | A | * | 10/1910 | Collar | 405/97 |
| 1,130,097 | A | * | 3/1915 | Meikle | 405/97 |
| 1,587,616 | A | * | 6/1926 | Sudler | 405/100 |
| 1,648,535 | A | * | 11/1927 | Broome | 405/104 |
| 1,738,051 | A | * | 12/1929 | Harker | 405/89 |
| 2,026,656 | A | * | 1/1936 | Schon | 405/104 |
| 2,307,077 | A | * | 1/1943 | Reagan | 318/672 |
| 2,667,748 | A | * | 2/1954 | Heath | 405/92 |
| 2,689,459 | A | * | 9/1954 | Mayo, Sr. | 405/95 |
| 2,699,653 | A | * | 1/1955 | Ponsar | 405/96 |
| 2,776,541 | A | * | 1/1957 | Fortes | 405/95 |
| 3,495,411 | A | * | 2/1970 | Clemens | 405/89 |
| 4,073,147 | A | * | 2/1978 | Nomura | 405/94 |
| 5,171,102 | A | * | 12/1992 | De Wit | 405/101 |
| 5,372,456 | A | * | 12/1994 | Langemann | 405/92 |
| 8,246,272 | B1 | * | 8/2012 | Heitz | 405/92 |
| 2012/0219360 | A1 | * | 8/2012 | Morii et al. | 405/100 |
| 2012/0237297 | A1 | * | 9/2012 | Morii et al. | 405/21 |
| 2013/0209173 | A1 | * | 8/2013 | Quek | 405/87 |

FOREIGN PATENT DOCUMENTS

| | | | | |
|---|---|---|---|---|
| CN | 203160209 | U | * | 8/2013 |
| DE | 422233 | C | * | 11/1925 |
| DE | 517393 | C | * | 2/1931 |
| DE | 610988 | C | * | 3/1935 |
| DE | 648292 | C | * | 7/1937 |
| DE | 1038992 | B | * | 9/1958 |
| FR | 548215 | A | * | 1/1923 |
| FR | 554805 | A | * | 6/1923 |
| FR | 566201 | A1 | * | 2/1924 |
| FR | 771871 | A | * | 10/1934 |
| FR | 837529 | A | * | 2/1939 |
| FR | 2033187 | A1 | * | 12/1970 |
| FR | 2288820 | A1 | * | 5/1976 |
| FR | 2926095 | A1 | * | 7/2009 |
| JP | 64-43675 | A | | 2/1989 |
| JP | 04203112 | A | * | 7/1992 |
| JP | 06200514 | A | * | 7/1994 |
| JP | 2000-319857 | A | | 11/2000 |
| JP | 2001-214425 | A | | 8/2001 |
| JP | 2003-253912 | A | | 9/2003 |
| JP | 2006022517 | A | * | 1/2006 |
| JP | 4388494 | B2 | | 10/2009 |
| JP | 2011111761 | A | * | 6/2011 |
| JP | 2011202474 | A | * | 10/2011 |
| JP | 2013144913 | A | * | 7/2013 |
| JP | 2013199792 | A | * | 10/2013 |
| JP | 2013249584 | A | * | 12/2013 |
| JP | 2013253381 | A | * | 12/2013 |

OTHER PUBLICATIONS

International Search Report for International Application No. PCT/JP2012/079294, dated Feb. 12, 2013, 1 page.

* cited by examiner (a)

(b)

(a)

(b)

FLOATING FLAP GATE

This application is a 371 application of PCT/JP2012/79294 having an international filing date of Nov. 12, 2012, which claims priority to JP2012-6512 filed Jan. 16, 2012, the entire contents of which are incorporated herein by reference.

TECHNICAL FIELD

The present invention relates to a floating flap gate which is disposed at an opening in a seawall in order to prevent a rising water from flowing into living spaces or underground spaces at a time of rising water, by causing a door body to float to block the opening.

BACKGROUND ART

A floating flap gate exists which is disposed at an opening of a seawall and blocks the opening at the time of a rising water in order to prevent the rising water from flowing into living spaces or underground spaces, by causing a door body to float, using a buoyancy of the water which is trying to flow in (e.g., Patent Reference 1).

However, the floating flap gate disclosed in Patent Reference 1 has a problem in that if a speed of the inflowing water is rapid, the floating action of a door body 1 is delayed, resulting in an overflow of water into living spaces or underground spaces (see FIG. 10(*a*)).

In addition, when the water level drops, the door body 1 stays at a raised state up to a water level which is about ⅓ the height of the door body 1, and subsequently exhibits a hazardous behavior such as suddenly falling (see FIG. 10(*b*)).

In order to prevent the problem of overflow during the initial influx of water, there was proposed a floating flap gate with a rope having a counterweight attached to one end, and with the other end connected to the door body via a pulley (e.g., Patent Reference 2).

The floating flap gate disclosed in Patent Reference 2 solves the problem of the delayed floating action of the door body during the initial influx of water by compensating for an insufficient buoyancy of the floating flap gate by using the weight of a counterweight.

However, the floating flap gate disclosed in Patent Reference 2 does not readily lower when the water level drops, because weight of the counterweight continually operates in a direction which assists in the floating action of the door body.

Moreover, in order to avoid a sudden falling action, which was one of the problems described above, a system was disclosed in Patent Reference 3, which employs a damper circuit to dampen the falling speed while the door body is being lowered. However, in the case of the system disclosed in Patent Reference 3, there is a risk of generating an overflow at the time of an initial influx, because the damper circuit dampens the rising speed while the door body is rising.

Patent Reference 1: Japanese Patent Application Kokai Publication No. 2001-214425

Patent Reference 2: Japanese Patent Application Kokai Publication No. 2003-253912

Patent Reference 3: Japanese Patent No. 4,388,494

SUMMARY OF THE INVENTION

Problems to be Solved by the Invention

One problem which the present invention aims to solve is that it becomes difficult to lower the door body when the water level drops, if a device is installed to continually assist the floating action of the door body with the intention of solving the problem of a floating flap gate of the prior art. Another problem is the risk of generating an overflow at the time of the initial influx, if a damper circuit is installed to dampen the falling speed while the door body is being lowered.

Means for Solving These Problems

The present invention was devised with the object of increasing a speed of operation of the door body at the time of the initial influx (when the door body starts to rise) and when the door body begins to lower, and the present invention was devised with the object of mitigating a shock which occurs when raising of the door body is completed and when lowering of the door body is completed. A further object of the present invention is to make it possible to set the door body so that it will float at any water level.

The floating flap gate according to the present invention is a floating flap gate which is disposed at an opening or at an access way, so as to block the opening or the access way when water flows in, having as its most essential features:

a door body with a forward end which is able to swing upwards, in a direction in which the water flows in and within a plane in a height direction, around a base end thereof serving as a fulcrum; and an auxiliary force generating means attached to one end of a rope, the other end of which is attached to the door body, the auxiliary force generating means comprising:

a counterweight inside which is formed a space, an elastic member disposed in the space within the counterweight, so that when a compressive force operates, the elastic member reacts to the compressive force, and tries to return to its original state, and a presser plate connected to the one end of the rope passing through a central portion of the elastic member disposed within the space via a hole formed in a ceiling of the counterweight, the presser plate being brought into contact with a lower surface of the elastic member to cause the compressive force to operate on the elastic member.

The present invention operates as described below, by employing an auxiliary force generating means which has a configuration in which a presser plate connected to the other end of the rope passing through a central portion of the elastic member via a hole formed in a ceiling of the counterweight, is brought into contact with a lower surface of the elastic member disposed in a space formed within the counterweight.

When the door body starts to rise, the rising speed of the door body increases, because the rope is pulled by the repellent force of the elastic member, but the rising speed of the door body decreases at the final stage of raising of the door body, because an auxiliary force is generated by the repellent force of the elastic member before the door body finishes rising.

When the door body starts to lower, the rope is pulled and the falling speed of the door body increases, because an auxiliary force is generated by the repellent force of the elastic member, but the falling speed of the door body decreases at the final stage of lowering of the door body, because an auxiliary force is generated by the repellent force of the elastic member before lowering of the door body is completed.

If the above-described present invention is further provided with a height position adjustment mechanism for adjusting the height position at the highest point of the auxiliary force generating means, it becomes possible to adjust the initial auxiliary force of the elastic member.

Advantageous Effects of the Invention

According to the present invention, at the initial stage of raising the door body, it is possible to increase the rising speed of the door body and to prevent an overflow during the initial influx of water, because the rope is pulled by the repellent force of the elastic member. On the other hand, a shock which occurs when raising of the door body is completed can be mitigated because an auxiliary force is generated by the repellent force of the elastic member before raising of the door body is completed, so that the rising speed of the door body decreases at the final stage of raising of the door body.

When the door body begins to lower, an auxiliary force is generated by the repellent force of the elastic member, pulling the rope, and increasing the falling speed of the door body, thus enhancing the ability of the door body to follow the water level. On the other hand, before lowering of the door body is completed, an auxiliary force is generated by the repellent force of the elastic member, decreasing the lowering speed of the door body at the final stage of lowering of the door body, thus making it possible to mitigate the shock which occurs when lowering of the door body is completed.

If the above-described present invention is further provided with a height position adjustment mechanism for adjusting the height position at the highest point of the auxiliary force generating means, it becomes possible to adjust the initial auxiliary force of the elastic member, thus making it possible to set the door body so that it will float at any water level.

BRIEF DESCRIPTION OF THE DRAWINGS

FIG. 10(*a*) illustrates the initial stage of influx, and FIG. 10(*b*) illustrates a time when the water level has dropped.

PREFERRED EMBODIMENT

According to the present invention, the object of increasing the speed of operation of the door body at the initial stage of influx or when the door body begins to lower, and the object of mitigating the shock which occurs when raising of the door body is completed and when lowering of the door body is completed, are achieved by providing an auxiliary force generating means which has a configuration in which a presser plate connected to the other end of the rope passing through a central portion of the elastic member via a hole formed in the ceiling of the counterweight, is brought into contact with a lower surface of the elastic member disposed in a space formed within the counterweight.

EXAMPLE

An example of the present invention is described in detail below using FIG. 1 to FIG. 6.

Figure 1:
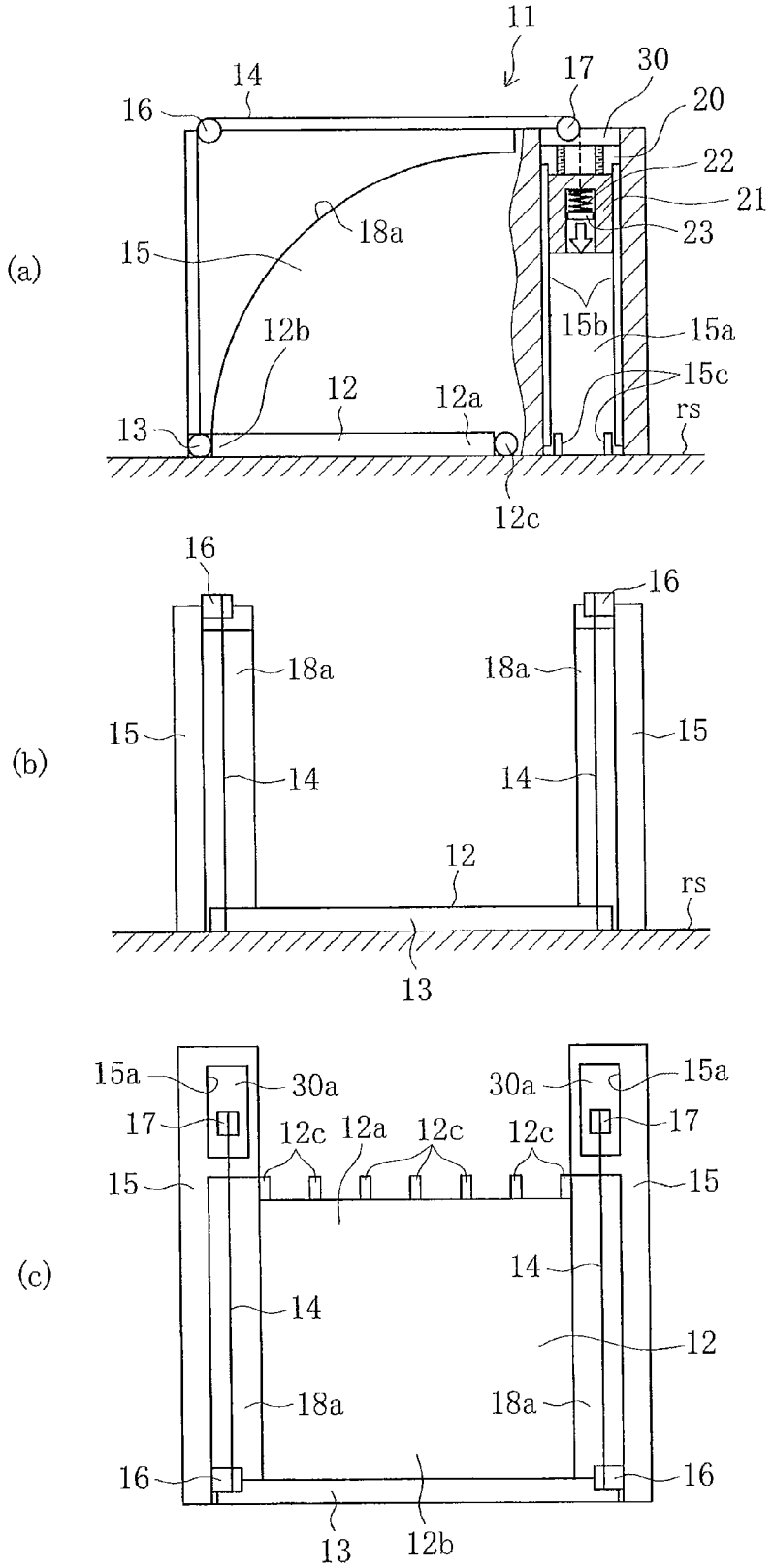
FIG. 1 is a schematic structural drawing of the floating flap gate according to the present invention, where FIG. 1(*a*) is a side view, FIG. 1(*b*) is a front view, and FIG. 1(*c*) is a planar view.

FIG. 1 is a schematic structural drawing of the floating flap gate according to the present invention.

In FIG. 1, Reference Numeral 11 is a floating flap gate according to the present invention which is disposed on a channel surface rs at an opening in a seawall, for example. When a water w tries to flow from an ocean (or from a river) into a living space or an underground space, the floating flap gate 11 uses the pressure of the in-flowing water w to swing a forward end 12*b* of a door body 12 upwards around a rotating shaft 12*c* of a base end 12*a* as a fulcrum, to block the opening in a water-tight manner. Reference Numeral 18*a* represents guides formed on door bumpers 15 to guide the door body 12 as it swings upwards.

If there is a wide opening to be blocked by the door body 12 of the floating flap gate 11, then a plurality of door bodies 12 may be linked width-wise at the opening, and the spaces between the various door bodies 12 are joined together with water-tight rubber. In addition, water-tight rubber is provided on the sides corresponding to door bumpers 15 of the door bodies 12, which are provided at the opening of the seawall.

The floating flap gate 11 shown in FIG. 1 has, for example, a rod 13, attached across the entire width-wise direction in the vicinity of the forward end of the door body 12, which functions to support the load resulting from the water pressure and to attach one end of a wire rope 14.

The other end of the wire rope 14 is attached to an auxiliary force generating means 20 disposed in a holding space 15*a* provided within the door bumpers 15, via a first fixed pulley 16 disposed in the door bumpers 15 above the forward end of the door body 12 and a second fixed pulley 17 disposed in the door bumpers 15 above the base end side of the door body 12 when it is lowered.

Figure 2:
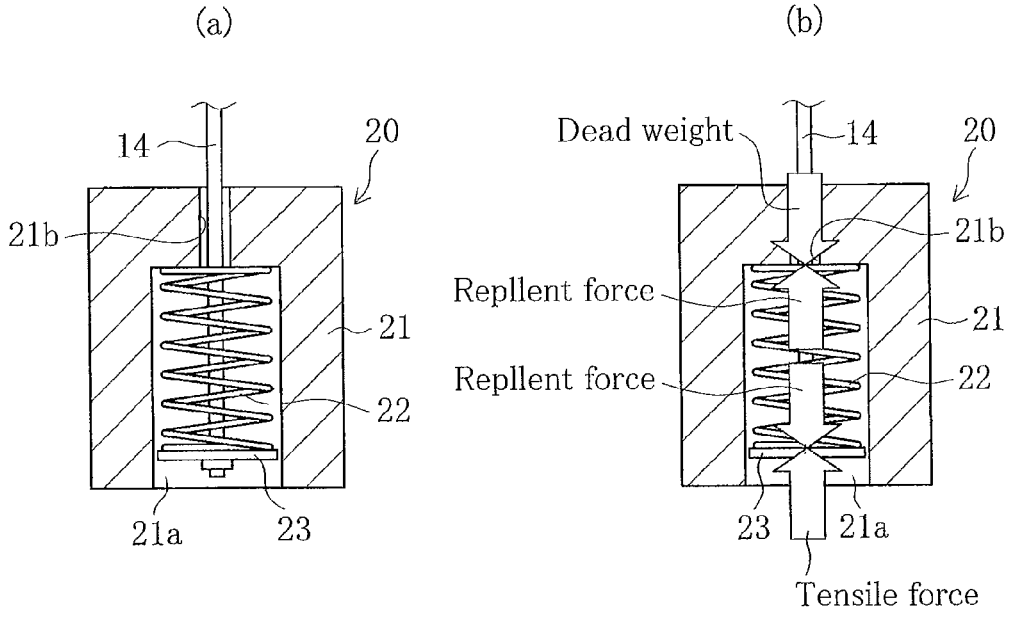
FIG. 2 is a drawing illustrating a case where a compression coil spring is used as the elastic member which is a structural element of the auxiliary force generating means of the floating flap gate according to the present invention, where FIG. 2(*a*) is an enlarged view of the structure, and FIG. 2(*b*) is a drawing illustrating the forces operating on the compression coil spring during operation.

As shown in FIG. 2, for example, the auxiliary force generating means 20 moves up and down along a guide member 15*b* attached within the holding space 15*a*, and has a structure which includes a compression coil spring 22 serving as the elastic member in a space 21*a* which has an open lower portion and which is formed within a counterweight 21, and lower surface of the compression coil spring 22 is supported by a presser plate 23.

In addition, the presser plate 23 is connected to the other end of the wire rope 14 which passes through the central portion of the compression coil spring 22 via a hole 21*b* provided in the ceiling of the counterweight 21.

Figure 3:
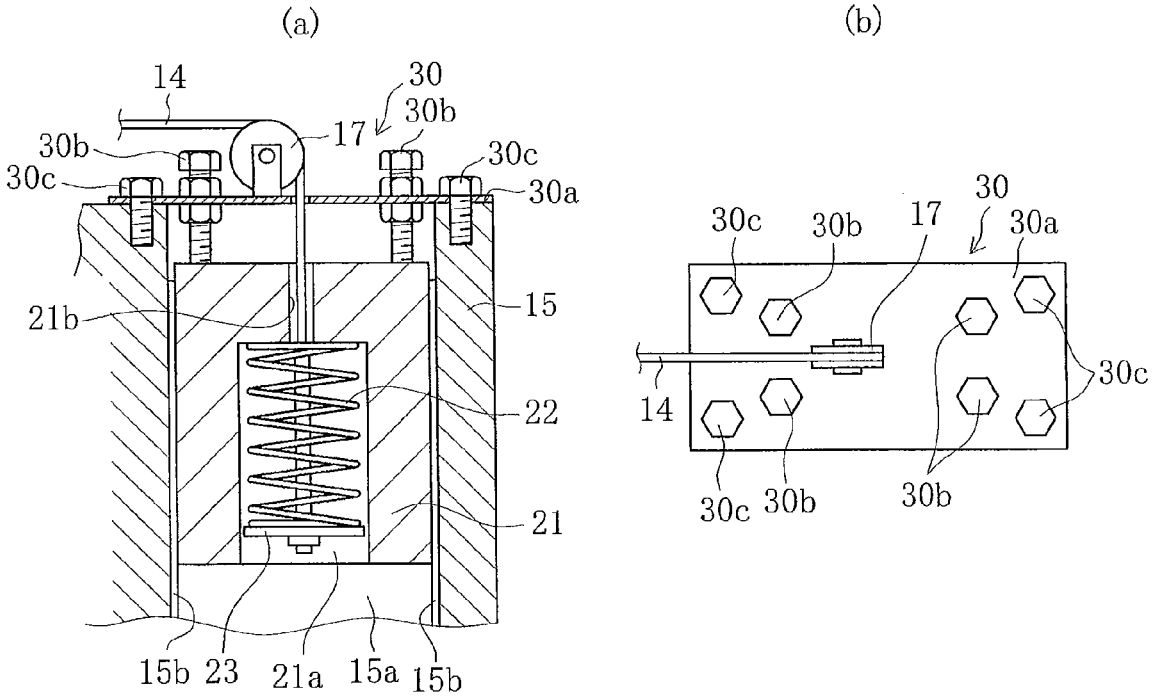
FIG. 3 is a drawing illustrating a height position adjustment mechanism for adjusting the height position at the highest point of the auxiliary force generating means of the floating flap gate according to the present invention, where FIG. 3(*a*) is a front view, and FIG. 3(*b*) is a planar view.
Figure 4:
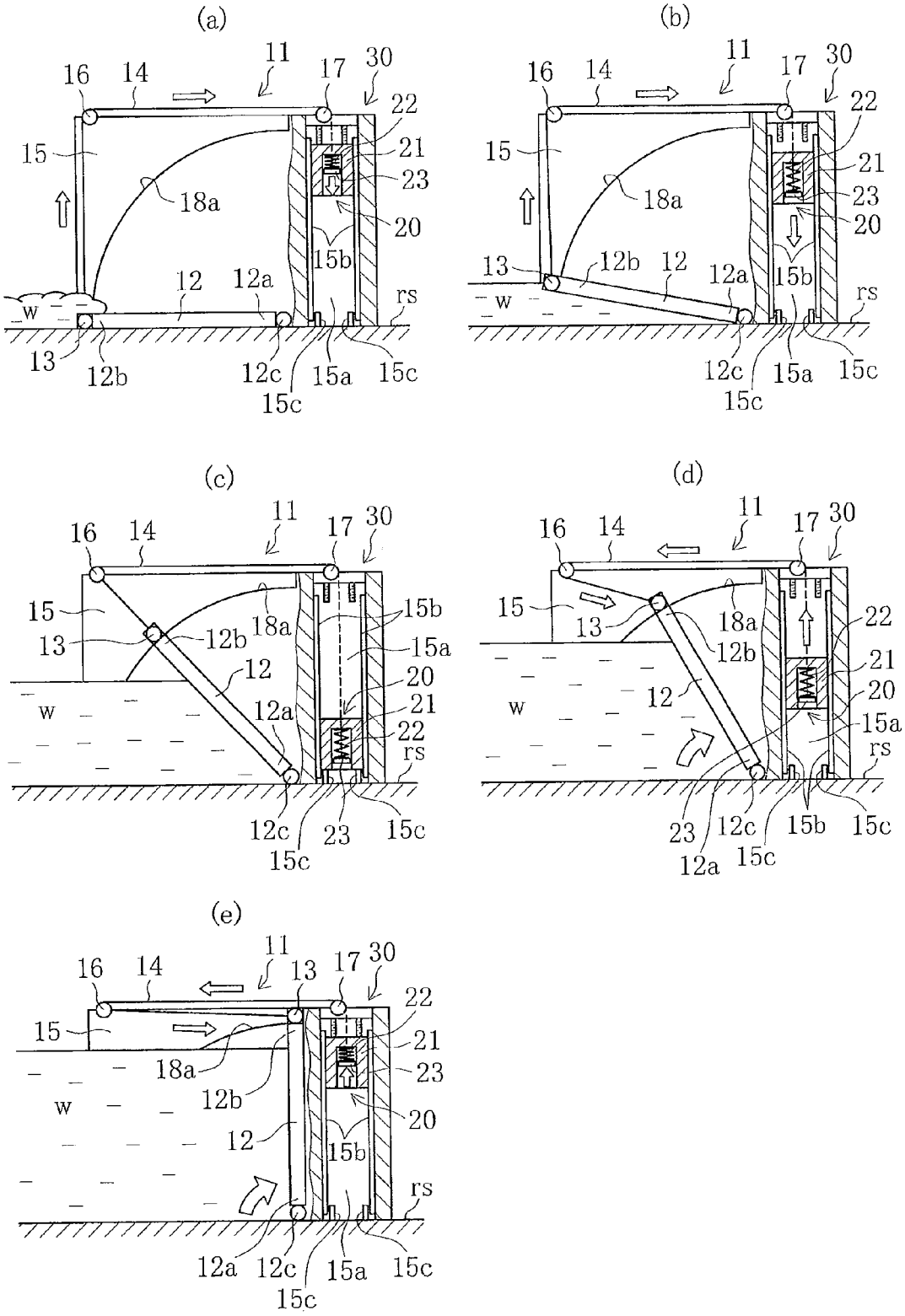
FIG. 4 is a drawing illustrating the operating principle during raising of the floating flap gate according to the present invention, where FIG. 4(*a*) is an initial stage of influx of water, FIG. 4(*b*) is an initial stage of raising the door body, FIG. 4(*c*) is an intermediate stage of raising the door body, FIG. 4(*d*) is a final stage of raising the door body, and FIG. 4(*e*) is a stage when raising the door body is completed.
Figure 5:
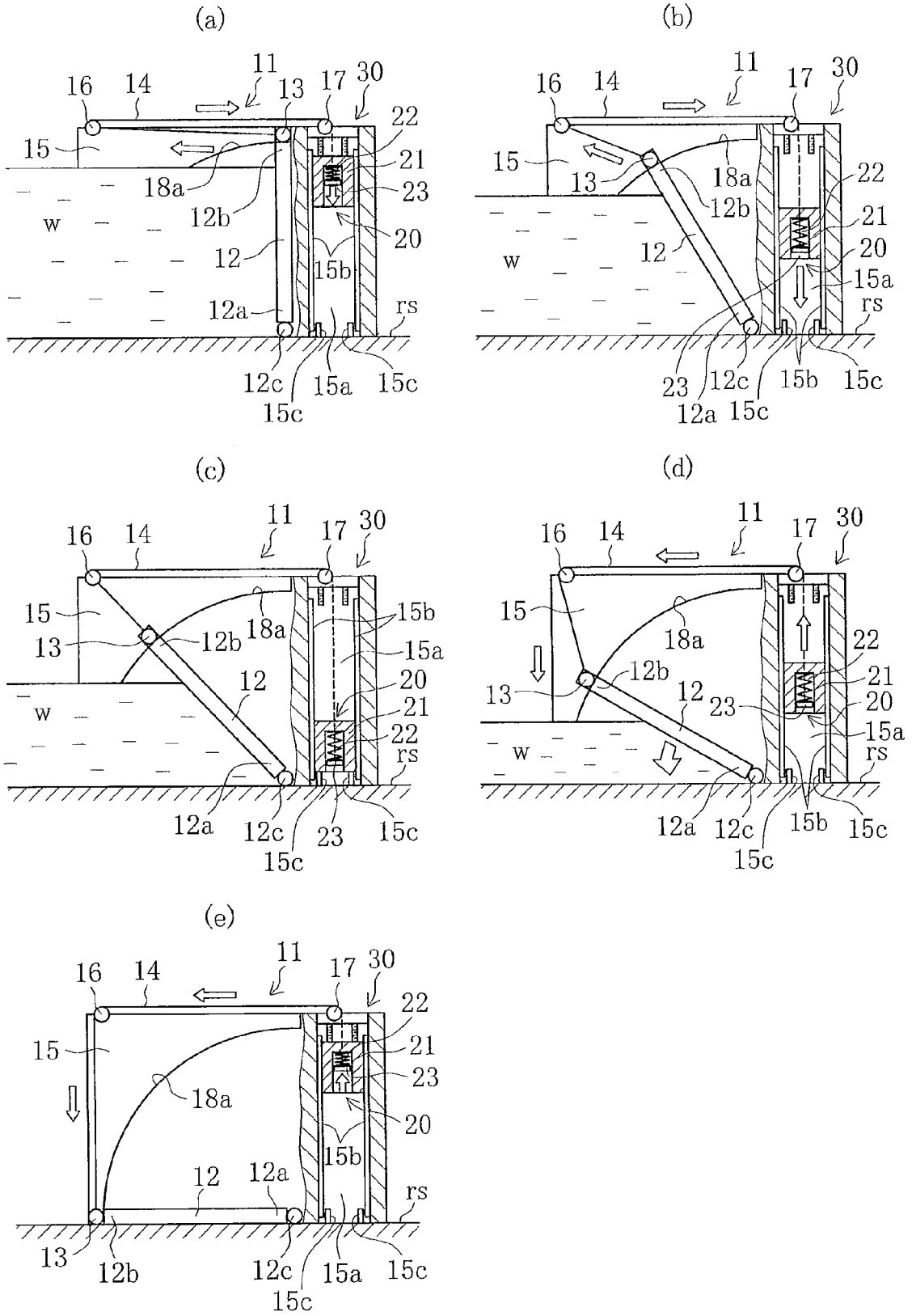
FIG. 5 is a drawing illustrating the operating principle during lowering of the floating flap gate according to the present invention, where FIG. 5(*a*) is when lowering of the door body starts, FIG. 5(*b*) is an initial stage of lowering the door body, FIG. 5(*c*) is an intermediate stage of lowering the door body, FIG. 5 (*d*) is a final stage of lowering the door body, and FIG. 5(*e*) is a stage when lowering the door body is completed.

Reference Numeral 30 is a height position adjustment mechanism for adjusting the height position at the highest point of the auxiliary force generating means 20, and, as shown in FIG. 3, it has a structure in which 4 machine bolts 30*b* are screwed into a mounting plate 30*a* to which is attached the second fixed pulley 17.

Such a height position adjustment mechanism 30 makes it possible to adjust a compressive force applied to the compression coil spring 22, by varying the height position at the highest point of the auxiliary force generating means 20 according to the penetration depth of the machine bolts 30*b* into the mounting plate 30*a* and by varying the stroke amount of the wire rope 14 which is due to the compression coil spring 22 alone. In FIG. 3, Reference Numeral 30*c* is a bolt for affixing the mounting plate 30*a*.

The floating flap gate 11 of the present invention which has the above-described configuration exhibits the functions described below when raising and lowering the door body 12.

When Raising the Door Body 12: See FIG. 4

Initial Stage of Influx of Water: See FIG. 4(*a*)

During the initial stage of influx of water, the auxiliary force generating means 20 is positioned at the maximum upper limit, and the compression coil spring 22 is in a compressed state, so the repellent force of the compression coil spring 22 causes the wire rope 14 to pull the door body 12 in the direction of rising, thereby assisting in raising of the door body 12. This auxiliary force decreases as the repellent force of the compression coil spring 22 decreases.

Initial Stage of Raising the Door Body: See FIG. 4(*b*)

The compression coil spring 22 gradually expands as the door body 12 rises. When the repellent force of the compression coil spring 22 decreases until the weight of the counterweight 21 is no longer supported, the counterweight 21 starts to descend. Subsequently, the counterweight 21 is supported by the repellent force of the compression coil spring 22, and the weight of the counterweight 21 operates on the wire rope 14 to assist in raising the door body 12.

Intermediate Stage of Raising the Door Body: See FIG. 4(*c*)

When the door body 12 rises to an intermediate height (where the angle of raising of the door body 12 is about 35-55°, the counterweight 21 lowers to reach support plates 15*c* which are installed within the holding space 15*a* of the door bumpers 15. When the counterweight 21 reaches the support plates 15*c*, the load of the counterweight 21 is released from the compression coil spring 22, resulting in the compression coil spring 22 returning to a free length and a load of 0, and a tensile force no longer operates on the wire rope 14.

Final Stage of Raising the Door Body: See FIG. 4(*d*)

When the door body 12 rises beyond an intermediate height, and the wire rope 14 is pulled by the rising action of the door body 12 (the water pressure operates on the door body 12), the compression coil spring 22 is compressed. When the weight of the counterweight 21 is supported by the repellent force of the compression coil spring 22, the counterweight 21 moves away from the support plates 15*c*, and starts to rise. Then, the counterweight 21 is supported by the repellent force of the compression coil spring 22, and the weight of the counterweight 21 operates on the wire rope 14, so that a sudden raising of the door body 12 is avoided.

Stage when Raising the Door Body is Completed: See FIG. 4(*e*)

When the door body 12 approaches the maximum angle of raising, and the counterweight 21 comes into contact with the machine bolts 30*b*, reaching its highest point, the entire tensile force of the wire rope 14 operates on the compression coil spring 22, so that the compression coil spring 22 is compressed. When this happens, an auxiliary force is generated in the direction of lowering of the door body 12, due to the repellent force of the compression coil spring 22, making it possible to mitigate the shock which occurs when raising of the door body is completed.

When Lowering the Door Body 12: See FIG. 5

When Lowering of the Door Body Starts: See FIG. 5(*a*)

At the time when lowering of the door body 12 starts from the maximum angle of raising, the compression coil spring 22 is in a compressed state, so the wire rope 14 is pulled by the repellent force of the compression coil spring 22, and an auxiliary force operates in the direction of lowering, to assist in lowering the door body 12. This auxiliary force decreases as the repellent force of the compression coil spring 22 decreases.

Initial Stage of Lowering the Door Body: See FIG. 5(*b*)

The compression coil spring 22 gradually expands as the door body 12 lowers. When the repellent force of the compression coil spring 22 decreases until the weight of the counterweight 21 is no longer supported, the counterweight 21 starts to descend. Subsequently, the counterweight 21 is supported by the repellent force of the compression coil spring 22, and the weight of the counterweight 21 operates on the wire rope 14 to assist in lowering the door body 12, and the door body 12 lowers in conjunction with the falling water level.

Intermediate Stage of Lowering the Door Body: See FIG. 5(*c*)

When the door body 12 lowers to an intermediate height (where the angle of raising of the door body 12 is about 35-55°, the counterweight 21 lowers to reach support plates 15*c* which are installed within the holding space 15*a* of the door bumpers 15. When the counterweight 21 reaches the support plates 15*c*, the load of the counterweight 21 is released from the compression coil spring 22, resulting in the compression coil spring 22 returning to a free length and a load of 0, and a tensile force no longer operates on the wire rope 14.

Final Stage of Lowering the Door Body: See FIG. 5(*d*)

When the door body 12 lowers beyond an intermediate height, the wire rope 14 is pulled by the lowering action of the dead weight of the door body 12, and the compression coil spring 22 is compressed. When the weight of the counterweight 21 is supported by the repellent force of the compression coil spring 22, the counterweight 21 moves away from the support plates 15*c*, and starts to rise. Then, the counterweight 21 is supported by the repellent force of the compression coil spring 22, and the weight of the counterweight 21 operates on the wire rope 14, so that a sudden falling of the door body 12 is avoided.

Stage when Lowering the Door Body is Completed: See FIG. 5(*e*)

When the door body 12 approaches the lowering limit, and the counterweight 21 comes into contact with the machine bolts 30*b*, reaching its highest point, the entire tensile force of the wire rope 14 operates on the compression coil spring 22, so that the compression coil spring 22 is compressed. When this happens, an auxiliary force is generated in the direction of raising of the door body 12, due to the repellent force of the compression coil spring 22, so as to mitigate the shock which occurs when lowering of the door body is completed.

The floating flap gate 11 according to the present invention described above makes it possible to assist the door body 12 when it is being raised and lowered, to mitigate shock, and to follow the water level, by employing the auxiliary force generating means 20 which uses the counterweight 21 and the compression coil spring 22 to implement a plurality of functions.

Figure 6:
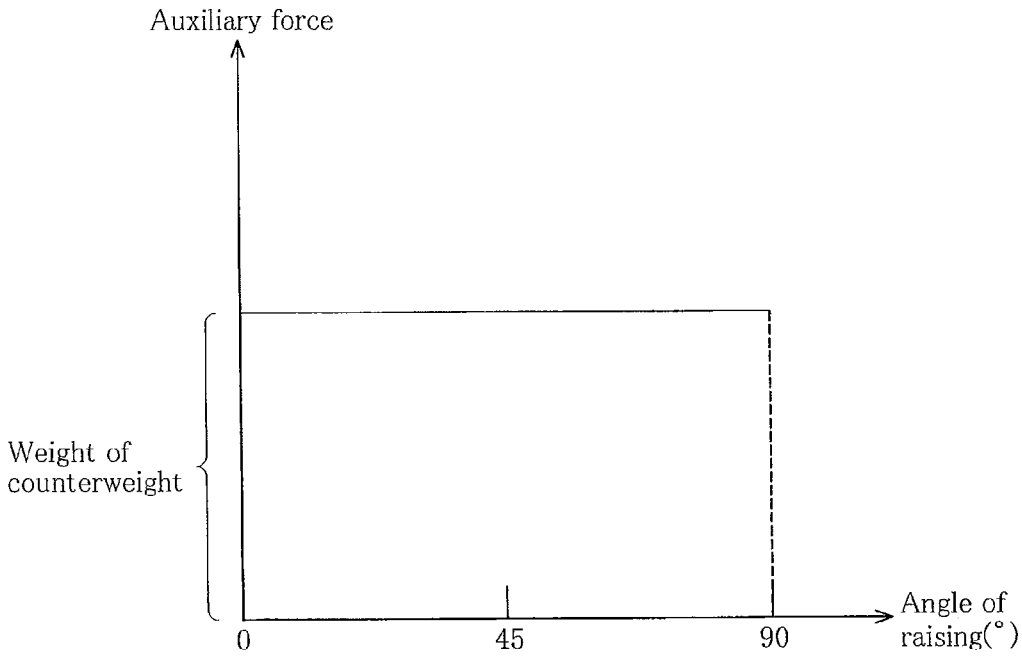
FIG. 6 is a drawing illustrating the relationship between the angle of raising of the door body of the floating flap gate and the auxiliary force, where FIG. 6(*a*) is a case in which only a counterweight is used, and FIG. 6(*b*) is a case in which a counterweight and a compression coil spring are used.
Figure 6:
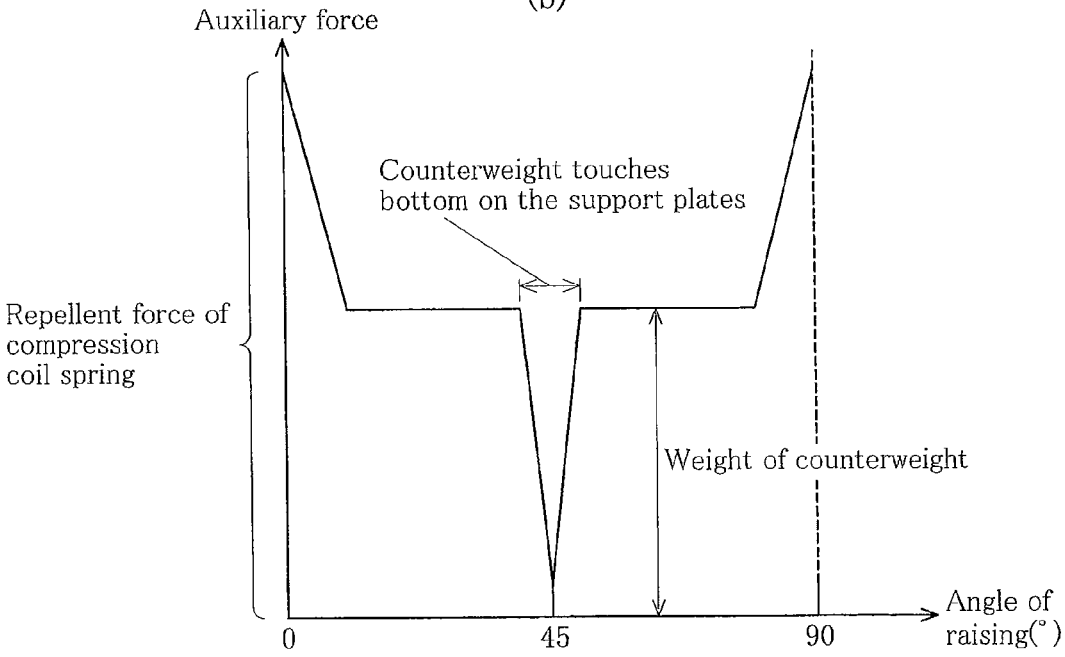

The floating flap gate 11 according to the present invention, which has the auxiliary force generating means 20 which uses the counterweight 21 and the compression coil 22, is able to increase the auxiliary force in the vicinity of raising limit of the door body 12 and in the vicinity of lowering limit of the door body 12, as shown in FIG. 6(*b*). When the angle of raising of the door body 12 is around 45°, the counterweight 21 reaches the support plates, and the compression coil spring 22 gradually expands. FIG. 6(*b*) shows that when the angle of raising of the door body 12 is 45°, the compression coil spring 22 gradually expands until the repellent force becomes zero, but the compression coil spring 22 does not have to expand until the repellent force becomes zero.

If the auxiliary force generating means 20 is formed from only the counterweight 21, the auxiliary force consists of only the weight of the counterweight 21, so the auxiliary force remains constant, as shown in FIG. 6(*a*), regardless of the angle of raising of the door body 12.

In addition, as shown in the example of the present invention, if the support plates 15*c* are installed, the auxiliary force can be brought to zero if the door body 12 is at an intermediary height (where the angle of raising of the door body 12 is about 35-55°, and within this range, the ability of the door body 12 to follow the water level is enhanced.

Moreover, the present invention is not limited to the above-described example, and the preferred embodiment may, of course, be advantageously modified within the scope of the technical ideas recited in the claims.

Figure 7:
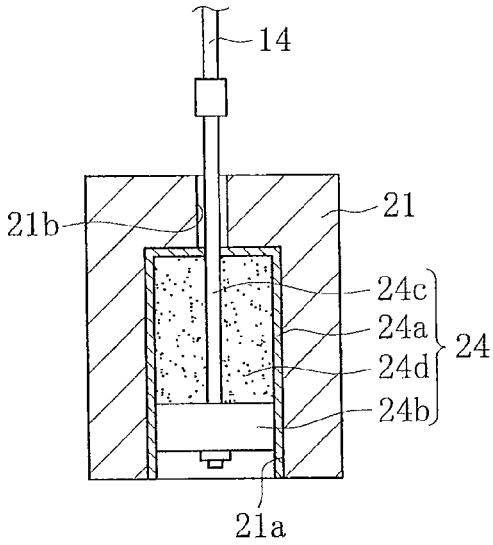
FIG. 7 is a drawing illustrating a case where a gas cylinder is used as the elastic member which is a structural element of the auxiliary force generating means of the floating flap gate according to the present invention.

For example, in the above described example, the auxiliary force generating means 20 employed both the counterweight 21 and the compression coil spring 22, but it is also possible to employ the counterweight 21 and a gas cylinder 24, as shown in FIG. 7.

In this case, the gas cylinder 24, which is formed from a cylinder 24*a* and a piston 24*b* as well as a rod 24*c*, is provided in the space 21*a* of the counterweight 21, and a gas 24*d* at a pressure greater than atmospheric pressure is sealed within the cylinder 24*a* on the side of the rod 24*c* which is sealed by the piston 24*b*. The rod 24*c* is caused to protrude through the hole 21*b* of the counterweight 21, connecting to the wire rope 14.

In the case of such a gas cylinder 24, when the wire rope 14 is pulled, the gas 24*d* within the cylinder 24 is compressed and generates a repellent force.

Figure 8:
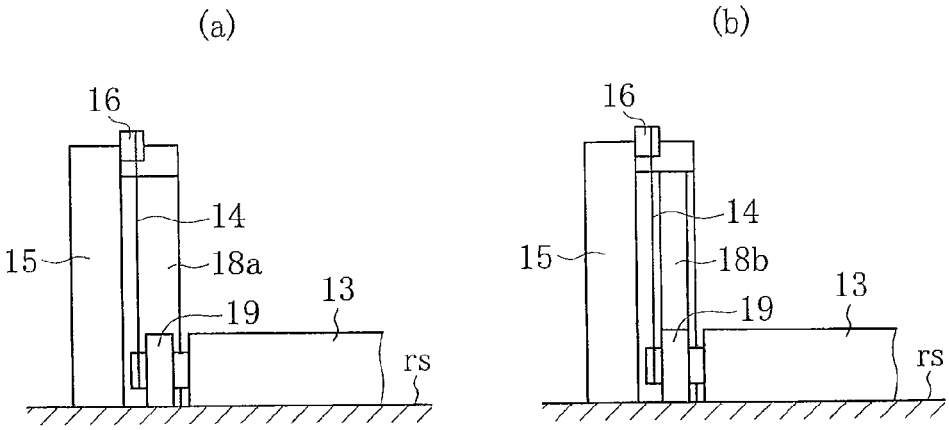
FIG. 8(*a*) is a drawing illustrating a portion of a floating flap gate according to the present invention corresponding to a portion where a wheel is attached to a rod, and FIG. 8(*b*) is a drawing illustrating a case where a rail is added to the structure of FIG. 8(*a*).

In the foregoing example, the rod 13, attached across the entire width-wise direction in the vicinity of the forward end of the door body 12, is guided by the guides 18*a*. However, as shown in FIG. 8(*a*), a wheel 19 may be attached to a portion which comes into contact with the rod 13 and the guides 18*a*. Moreover, as shown in FIG. 8(*b*), the wheel 19 attached to the rod 13 may be guided by a rail 18*b*.

Figure 9:
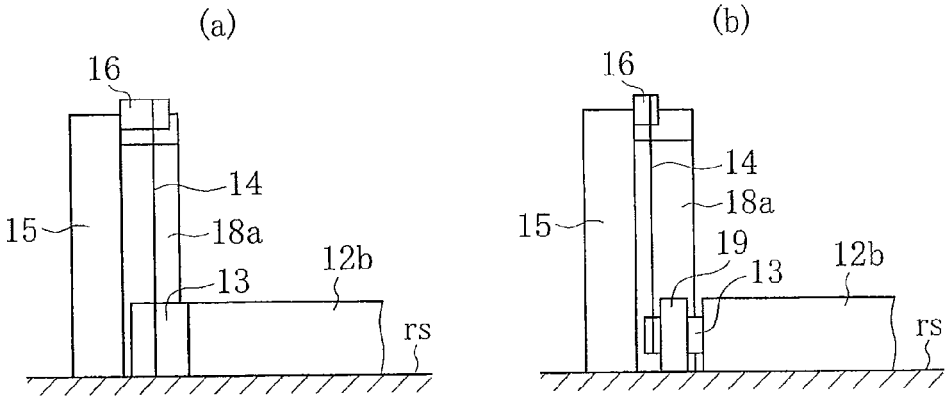
FIG. 9(*a*) is a drawing illustrating of a portion of a floating flap gate according to the present invention corresponding to a portion where the rod is optionally attached to both sides of the door body, and FIG. 9(*b*) is a drawing illustrating a case where a wheel is added to the structure of FIG. 9(*a*).
Figure 10:
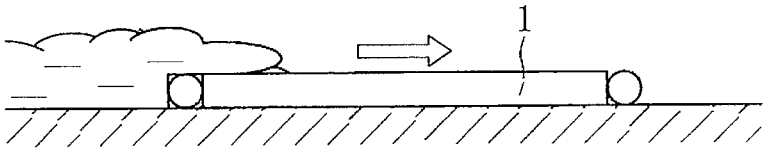
Fig.10 Prior Art
FIG. 10 is a drawing illustrating the problems of the floating flap gate according to the prior art.
Figure 10:
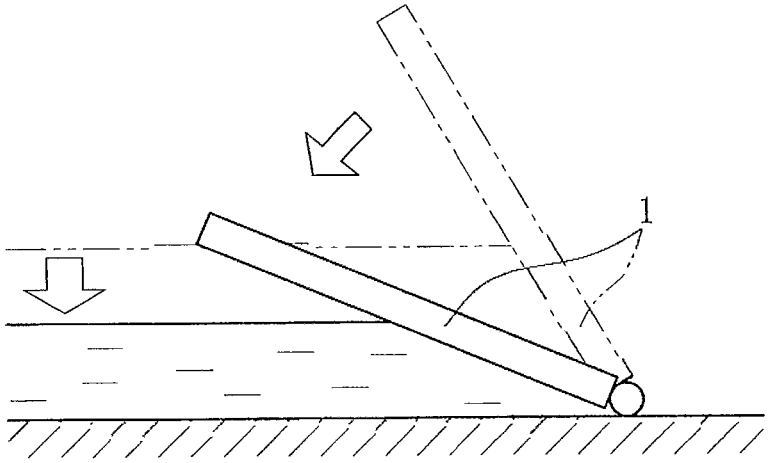
Fig.10 Prior Art

Moreover, in the foregoing example, the rod 13 was attached across the entire width-wise direction in the vicinity of the forward end of the door body 12, but, as shown in FIG. 9, the rod 13 may be attached only at the two sides of the door body 12. In this case, the wheel 19 may be attached to the portion which comes into contact with the rod 13 and the guides 18*a*, as shown in FIG. 9(*b*).

In the foregoing example, a wire rope 14 was used, but a rope may be used which is made from a fiber, such as a polyamide fiber, a polyester fiber, a polyethylene fiber, a polypropylene fiber, an aramid fiber, a polyarylate fiber, a high-density polyethylene fiber, or the like.

In the foregoing example, the floating flap gate had a door body 12 formed from a single floating body, but a floating body connection-type flap gate may be used wherein a plurality of floating bodies are connected in a direction of height.

In the foregoing example, the auxiliary force generating means 20 is installed in the holding space 15*a* within the door bumpers 15, but it may be installed outside of the door bumpers 15.

In the foregoing example, the guides 18*a* are disposed outside of the door bumpers 15, but they may be disposed within the door bumpers 15. Moreover, if a bottom hinge structure makes it possible for the door body 12 to swing downwards with the bottom hinge at the center, then it is not necessary to provide the guides 18*a* to the door bumpers 15.

In the foregoing example, the auxiliary force generating means 20 touched bottom at the support plates 15*c*, but the support plates 15*c* are not necessarily required structural elements.

The invention claimed is:

1. A floating flap gate which is disposed at an opening or at an access way, so as to block the opening or the access way when water flows in, the floating flap gate comprising:

a door body with a forward end which is able to swing upwards, in a direction in which the water flows in and within a plane in a height direction, around a base end thereof serving as a fulcrum; and an auxiliary force generating means attached to one end of a rope, the other end of which is attached to the door body, the auxiliary force generating means comprising:

a counterweight inside which is formed a space, an elastic member disposed in the space within the counterweight, so that when a compressive force operates, the elastic member reacts to the compressive force, and tries to return to its original state, and a presser plate connected to the one end of the rope passing through a central portion of the elastic member disposed within the space via a hole formed in a ceiling of the counterweight, the presser plate being brought into contact with a lower surface of the elastic member to cause the compressive force to operate on the elastic member.

2. The floating flap gate according to claim 1, wherein the elastic member is a compression spring.

3. The floating flap gate according to claim 1, further comprising a height position adjustment mechanism for adjusting the height position at the highest point of the auxiliary force generating means, making it possible to adjust the initial auxiliary force of the elastic member.

* * * * *